US009295869B2

(12) United States Patent
Washington

(10) Patent No.: US 9,295,869 B2
(45) Date of Patent: Mar. 29, 2016

(54) FUNCTIONAL RESISTANCE EXERCISE APPARATUS

(71) Applicant: Naqam Washington, New York, NY (US)

(72) Inventor: Naqam Washington, New York, NY (US)

( * ) Notice: Subject to any disclaimer, the term of this patent is extended or adjusted under 35 U.S.C. 154(b) by 90 days.

(21) Appl. No.: 14/270,943

(22) Filed: May 6, 2014

(65) Prior Publication Data

US 2015/0065317 A1 Mar. 5, 2015

Related U.S. Application Data

(63) Continuation-in-part of application No. 12/605,788, filed on Oct. 26, 2009, now abandoned.

(51) Int. Cl.

| | |
|---|---|
| ***A63B 21/02*** | (2006.01) |
| ***A63B 21/04*** | (2006.01) |
| ***A63B 21/055*** | (2006.01) |
| ***A63B 23/12*** | (2006.01) |
| ***A63B 23/14*** | (2006.01) |
| ***A63B 23/16*** | (2006.01) |

(52) U.S. Cl.

CPC ..... *A63B 21/0442* (2013.01); *A63B 21/0552* (2013.01); *A63B 21/0557* (2013.01); *A63B 21/4001* (2015.10); *A63B 21/4007* (2015.10); *A63B 21/4019* (2015.10); *A63B 21/4025* (2015.10); *A63B 23/12* (2013.01); *A63B 23/14* (2013.01); *A63B 23/16* (2013.01)

(58) Field of Classification Search

CPC ..... A63B 21/02–21/0557; A63B 21/1411; A63B 21/1415; A63B 21/1419; A63B 21/1449; A63B 21/1438; A63B 21/1442; A63B 71/143; A63B 71/145; A63B 71/146; A63B 71/148; A41D 19/0034; A41D 19/0037; A41D 19/0093; A41D 19/002; A41D 19/0024; A41D 19/01594; A41D 19/01552; A41D 19/0044; A41D 19/0048

USPC ..... 482/44–50, 105, 121–130, 139, 148, 482/904, 907; 2/159, 160, 161.1, 161.2, 2/161.4

See application file for complete search history.

(56) References Cited

U.S. PATENT DOCUMENTS

| | | | | | |
|---|---|---|---|---|---|
| 3,252,704 | A * | 5/1966 | Wilson | A61G 7/1017 | 2/238 |
| 4,639,947 | A * | 2/1987 | Lanscioni | A41D 19/01594 | 2/161.5 |
| 5,033,119 | A * | 7/1991 | Wiggins | A41D 19/01582 | 2/161.3 |
| 5,306,222 | A * | 4/1994 | Wilkinson | A41D 13/0015 | 482/121 |
| 5,476,435 | A * | 12/1995 | Nimmo | A63B 21/05 | 482/121 |
| 5,820,526 | A * | 10/1998 | Hoffman | A63B 21/065 | 441/57 |
| 5,993,362 | A * | 11/1999 | Ghobadi | A63B 21/0004 | 482/121 |

(Continued)

*Primary Examiner* — Oren Ginsberg
*Assistant Examiner* — Gregory Winter
(74) *Attorney, Agent, or Firm* — Bay State IP, LLC

(57) ABSTRACT

A functional resistance exercise apparatus includes a glove for a user's hand. At least one loop is securely disposed or formed on the glove, and a resistive element is attachable to the loop which generates force in opposition to the user's movement of the hand wearing the glove in substantially any direction. The resistive element is preferably an elastic band securable at one end to the loop and at the other end to a fixed point, or a cable attached to a weight. The apparatus preferably also includes a vest having at least one loop attached thereto. The band is attachable at one end to the glove and at the other end to the vest. Both the glove and the vest preferably have reinforced portions upon which their respective loops are attached to prevent stretching or tearing of the glove or vest.

10 Claims, 11 Drawing Sheets

(56) References Cited

U.S. PATENT DOCUMENTS 6,287,242 B1 * 9/2001 Fray ..... A63B 21/0004 482/121
6,393,615 B1 * 5/2002 Bedell ..... A41D 19/01547 2/159
6,659,921 B2 * 12/2003 Vernon ..... A63B 21/0552 482/114
7,908,672 B2 * 3/2011 Butler ..... A63B 21/0605 2/162
8,684,891 B1 * 4/2014 Davidson ..... B64D 17/30 244/142
2011/0185472 A1 * 8/2011 Voravan ..... A41F 1/008 2/161.2
2011/0301001 A1 * 12/2011 Hopper ..... A63B 21/0552 482/121

* cited by examiner

FUNCTIONAL RESISTANCE EXERCISE APPARATUS

CROSS REFERENCE TO RELATED APPLICATION

This applications is a Continuation-in-part application and claims priority to and takes the benefit from U.S. patent application Ser. No. 12/605,788 filed on Oct. 26, 2009, which in turn claims priority to and takes the benefit of U.S. Provisional Patent Application No. 61/113,992, filed Nov. 12, 2008, the contents of which are herein incorporated by reference.

BACKGROUND OF THE INVENTION

1. Field of the Invention

The invention relates to exercise equipment. More specifically, the invention relates to exercise equipment that enables the user to enjoy resistance training and/or rehabilitation while performing the various sporting activities for which the user is training in the first place, also known as functional resistance training.

2. Description of Related Art

Physical fitness is extremely important to a growing segment of the population. As the public becomes increasingly aware of already-known benefits of exercise, more and more people are exercising, in a variety of different ways. Some lift weights, some take yoga or similar classes, others run, bike, or pursue other cardiovascular activities. Some people enjoy combinations of all of the above.

Professional athletes and serious amateur competitors exercise quite often. One can develop one's skills in a sport by performing exercises that duplicate or simulate the motions required to perform that sport. For example, a baseball player might swing an extra-heavy bat or a weighted bat to develop stronger oblique muscles; that way, when called upon to swing a regular-weight bat during a game, the batter is well-equipped to crush the ball.

However, there are a lot of sports that involve a number of different movements for which there is no relevant equipment like a bat. In football, for example, wide receivers and running backs need to be able to run quickly and powerfully while holding/protecting the football. In boxing, the boxer must develop a whole slew of muscles and skills. Athletes need to be able to perform the activities of their sports in a practice or exercise setting while keeping their hands unencumbered by holding weights or the like. Additionally, when athletes or would-be athletes injure themselves, it is often extremely helpful and necessary for the injured person to undergo physical therapy to recover fully.

A field of physical fitness training and therapy has developed to address these needs, called functional resistance training. In functional resistance training, the person attempts to perform the movements and routines of his or her sport or activity, however some form of weight or load is added to the person to impede or retard the person's progress. For example, some people wear ankle or wrist weights when they jog, run, or box. These have the deleterious effect of interfering with the user's natural gait and movements, particularly because the additional weight is concentrated at the remote ends of the person's limbs. Others wear weighted vests which, unlike ankle and wrist weights, distribute the additional load much more evenly over the body. However, weighted vests also tend to put more strain on the wearer's back, knees, and other joints. Some athletes will also attempt to run while dragging a heavy item such as a cinderblock.

Since it can be difficult to drag a cinderblock along the ground, weights are commonly placed on a sled fitted with runners or the like so that the load has less frictional resistance with the ground but still provides a selective amount of weight for the user to drag around. A further option includes attempting to run while wearing a device that provides significant air resistance, such as a parachute or a sail.

In addition to the above-mentioned deficiencies with conventional functional resistance equipment, all of the above suffer from a common, major problem: they only provide resistance in substantially one direction. Ankle, wrist, or vest weights only provide resistance in a straight downward direction, owing to gravity. This downward pull does not lend significant resistance to movement in any direction other than up. The sled or parachute serves only to pull the user backward, and only at the torso where it is usually attached.

It is possible to exercise while submerged in water; the water provides much more resistance to movement than does air. However, it is impractical to use water for motion resistance for many activities, such as those where one's arms go above one's head (as the water level would have to be over the head of the person), or running (as the activity would be very slippery), or for physical rehabilitation in general. Of course, using water for motion resistance also requires a pool, which by itself, is extremely limiting.

Accordingly, there is a long-felt need to provide a functional resistance exercise device or system that will actually provide resistance to the user's movements regardless of the direction of the movement, in substantially any location or setting.

SUMMARY OF THE INVENTION

The invention is a functional resistance exercise apparatus that includes a glove wearable on a user's hand. At least one attachment mechanism such as a first loop is securely disposed on the glove, and a resistive load element is attachable to the loop which generates force in opposition to the user's movement of the hand wearing the glove in substantially any direction. The resistive element is preferably an elastic band securable at one end to the first loop and at the other end to a substantially fixed point. One end of the elastic band may further include a handle adapted to be held by a hand other than the hand upon which the glove is worn, i.e., the user's other hand, or the hand of another person such as a trainer or exercise buddy. Alternatively, the resistive element can be a cable connectable at one end to a weight and at the other end to the first loop on the glove. As another alternative, the resistance can be generated by another device, either known conventionally or to be developed.

The apparatus preferably also includes a torso-covering garment such as a vest having at least one loop attached thereto. The elastic band is attachable at one end to a loop on the glove and at the other end to a loop on the vest.

In the preferred embodiment, the loop on the glove includes an openable ring securable to the resistive element. In the case where the resistive element is an elastic band, the band may be provided with a loop at one or both ends which may be securable to the openable ring on the glove. Of course, the loop on the glove may be permanently closed and the elastic band may be provided with an openable ring. Alternatively, the loop on the glove may be made from the glove material itself by forming at least two holes in the glove and threading at least a portion of the resistive element through those at least two holes.

Both the glove and the vest preferably have reinforced portions upon which their respective loops are attached (and/ or holes are formed) so as to prevent stretching or tearing of either the glove or the vest by the application of the resistive load. The reinforced portion of either element is preferably less stretchable than a main portion thereof.

Multiple loops are preferably provided on both the glove and/or the torso-covering garment so as to provide greater flexibility, greater comfort, and more options as to the direction of the application of the resistive load.

The invention may include an outer cover disposed on the glove adapted to selectively cover the loop(s) on the glove. The outer cover may include a closing mechanism adapted to selectively secure the outer cover over the loop(s) on the glove. The closing mechanism may be a snap, a zipper, a hook-and-loop-type fastener (e.g., Velcro®), or the like, and/or any combination thereof.

Most generally, the invention is a functional resistance exercise apparatus having a glove wearable on a user's hand, the glove having a main section. At least one resistive load attachment mechanism is disposed on the glove, adapted to receive an attachable load which generates force in opposition to the user's movement of the hand wearing the glove in substantially any direction.

DETAILED DESCRIPTION OF THE INVENTION AND DRAWINGS

Description of the invention will now be given with reference to FIGS. 1-17. It should be understood that these figures are exemplary in nature and in no way serve to limit the scope of the invention, which is defined by the claims appearing hereinbelow.

The fundamental element of the invention is a functional resistance exercise glove or hand wrap. Several different versions of the inventive glove/wrap are depicted in FIGS. 1-8; all of these have common features, namely, at least one loop secured to the glove, preferably secured at a reinforced section, to which resistive elements such as elastic bands or cables can be attached. The specific features are described below.

Figure 1:
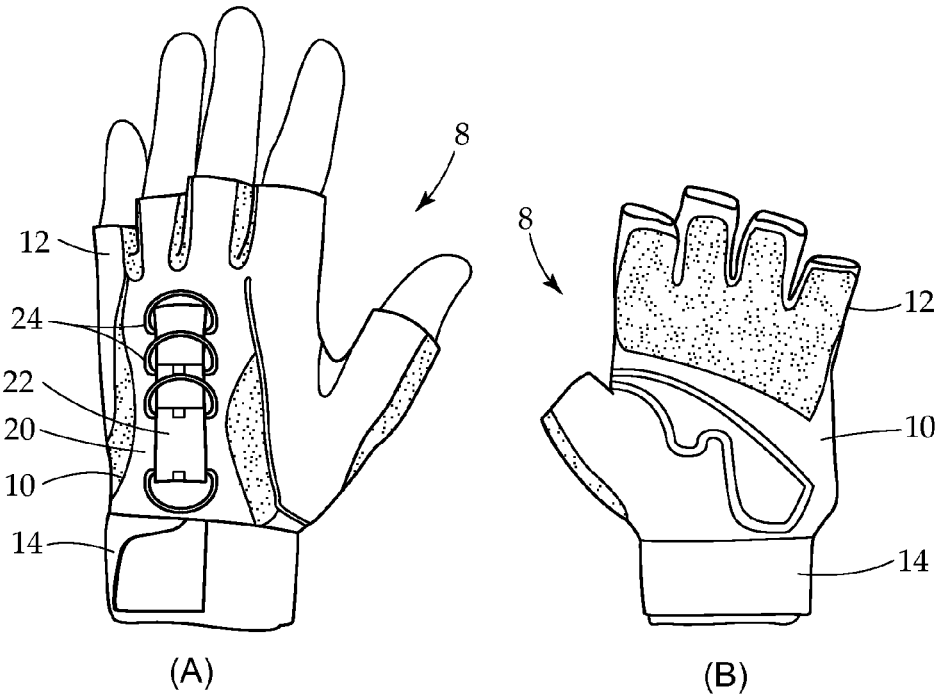
FIGS. 1A-B are rear and front perspective views of a glove portion of a functional resistance exercise apparatus in accordance with the invention.
Figure 2:
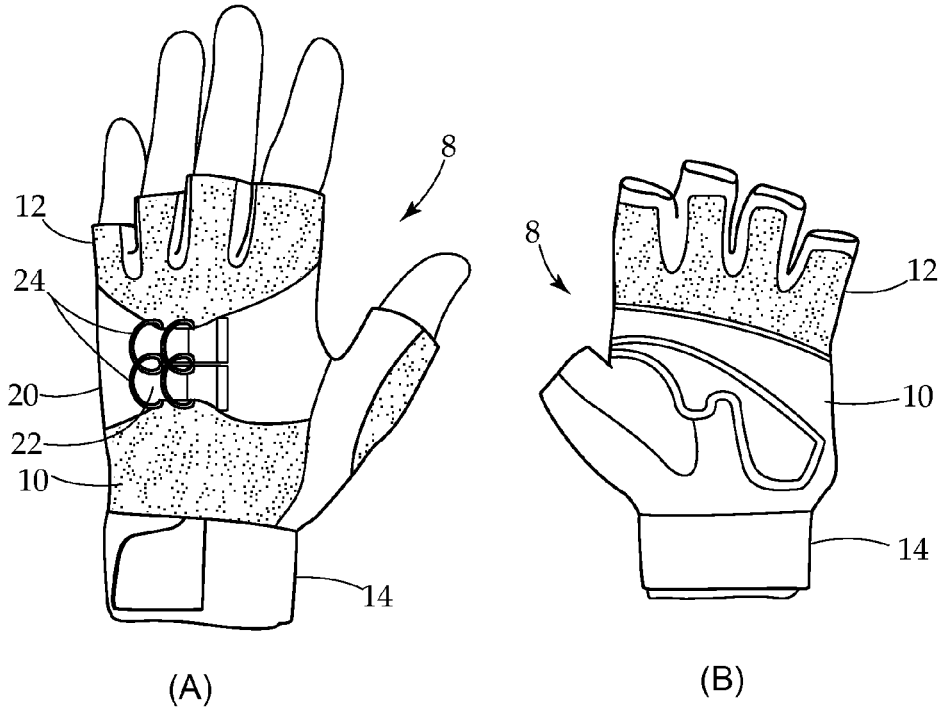
FIGS. 2A-B are rear and front perspective views of a slightly modified functional resistance exercise apparatus in accordance with the invention.
Figure 3:
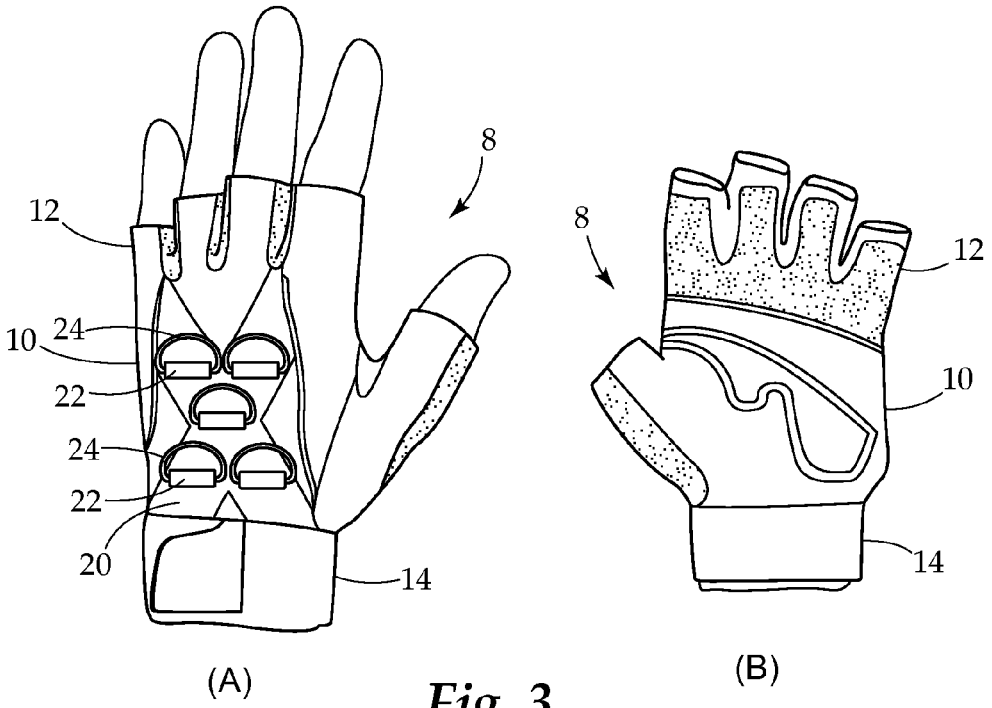
FIGS. 3A-B are rear and front perspective views of another slightly modified functional resistance exercise apparatus in accordance with the invention.

FIG. 1 depicts one version of the invention as glove 8. Glove 8 includes a main section 10, fingers 12, and wrist wrap 14. These features are common to conventional exercise gloves that are worn to protect the user's hands from abrasion and callusing from repeated gripping of dumbbells, barbells, and other exercise equipment, some of which is roughly knurled for better gripping. The invention also includes a reinforced section 20, made of a material that is less elastic than main section 10 and is thus less likely to be torn or stretched when pulled. Formed on reinforced section 20 are one or more loops 22 to which a resistive element (to be described below) may be attached. In the preferred embodiment, loop 22 also includes a ring 24 to which the resistive element may be more easily attached. It should be understood that the "loop" to which the resistive element may be attached is either the fabric loop 22 or the loop of ring 24 or some other portion of the glove itself. Attaching the resistive element to one or the other or to both, or via threading it though holes in the glove material itself (discussed below), are all considered to be within the scope of the invention.

Depending on manufacturer preference, ring 24 may be a closed loop ring such as a metal or plastic D-ring, or it may be an openable loop ring such as a carabiner ring. (Rings 24 shown in FIG. 1A are closed loop rings which are permanently attached to loops 22.) In any event, whether rings 24 are made to be removable or permanently attached to loops 22, loops 22 are preferably designed to be integrally formed with the glove, more preferably integrally formed with the reinforced section 20 of the glove.

One or more loops 22 and rings 24 may be provided; as shown in FIG. 1A, four loops 22 respectively secure four rings 24 substantially in a straight line. Multiple loops/rings offer the user the ability to change the location of a single resistive element to alter the angle of resistive force generated against the user's movement and/or to enable a greater degree of flexibility for various different movements. For example, were one to perform negative wrist curls using the invention, one would preferably attach the resistive element to the most distal ring 24 (the one closest to the fingers) to provide the biggest moment arm for the load away from the pivot point of the wrist. Multiple loops/rings also offer the user the ability to attach multiple resistive elements to the same glove. For example, should a person have developed sufficient strength to require more resistance than a single resistive element can provide, she could attach two or more. Alternatively, should the resistive elements be made available in various resistive strengths, one can mix and match multiple resistive elements to set the resistance level very precisely.

As mentioned above, glove 8 shown in FIGS. 1A-B includes four loops 22 respectively securing four rings 24 all in a line along reinforced section 20. FIGS. 2A-B depicts glove 8' which also has four loops 22 respectively securing four rings 24. (Here and throughout the specification, like elements are provided with like reference numerals, and the description thereof will not be repeated.) However, the loops/rings 22-24 of glove 8' are arranged in a two-by-two pattern instead of in a straight line. FIGS. 3A-B depicts glove 8", which includes five loops 22 respectively securing five rings 24 in an X pattern. Any number of loops/rings in any convenient pattern may be provided on the glove. Additionally, all of the above figures depict loops/rings disposed on the rear central portion of the glove; however, loops/rings may also be disposed on the fingers, the wrists, or the palms of the gloves.

Figure 4A:
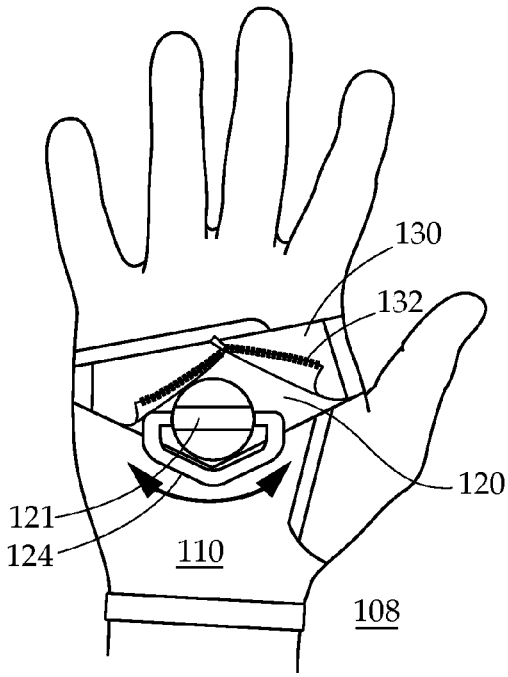
FIGS. 4A-B are rear elevation views of another functional resistance exercise apparatus in accordance with the invention having a cover.
Figure 4B:
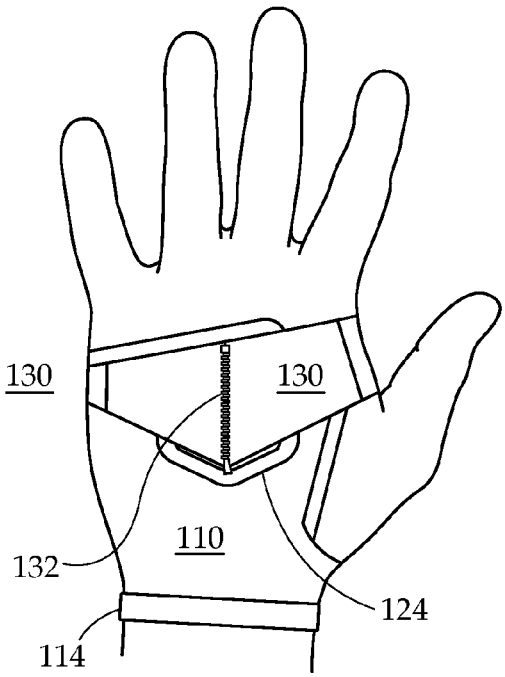
Figure 4C:
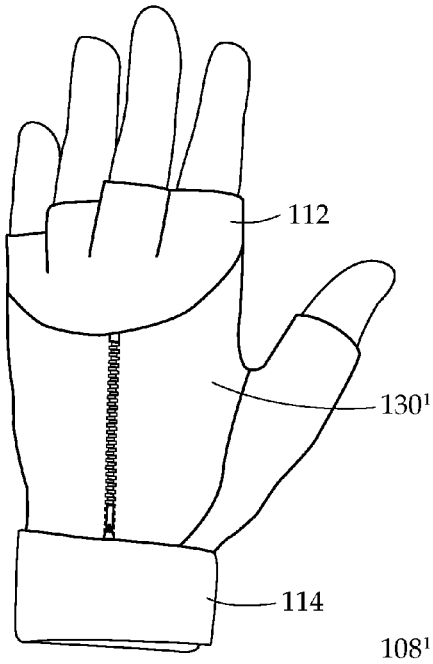
FIGS. 4C-D are rear elevation views of a slight modification to the apparatus of FIGS. 4A-B.
Figure 4D:
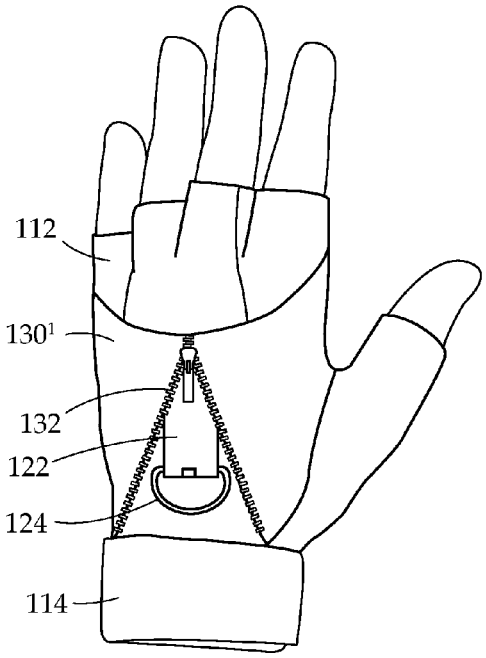

FIGS. 4A-D depict two versions of the functional resistance exercise glove of the invention with another feature: a cover to shield the loop and ring when not in use. In FIGS. 4A-B, glove 108 possesses a main section 10 and a wrist wrap 114; no fingers are provided for this glove, however the presence or absence of fingers or a wrist wrap is not relevant to the invention. Sewn or otherwise attached to main section 110 is reinforced section 120, again, made of a more durable and less elastic material than main section 110. Loop 124 is mounted into reinforced section 120, preferably via swivel mount 121 which enables loop 124 to rotate back and forth in the direction of arrow A. Swivel mounting loop 124 enables for greater flexibility and comfort in performing a wider variety of exercises. Cover 130 is also sewn or otherwise attached to glove 108 and is adapted to substantially cover loop 124. A closing mechanism is preferably provided integral with cover 130 to enable the user to select whether she wants cover 130 to be closed and secure the loop or to be open and enable access to the loop. In the embodiment shown, the closing mechanism is a zipper 132. Glove 108' shown in FIGS. 4C-D is similar to glove 108, with some variations. First, glove 108' includes fingers 112. Second, ring 124 of glove 108' is disposed on a loop 122 that is more akin to the loops 22 of FIGS. 1-3 than the swivel mount 121 of FIGS. 4A-B. Third, as best shown in FIG. 4C, cover 130' completely covers loop 122 and ring 124, whereas cover 130 allowed a portion of loop 124 to remain exposed even when cover 130 was closed.

Figure 6A:
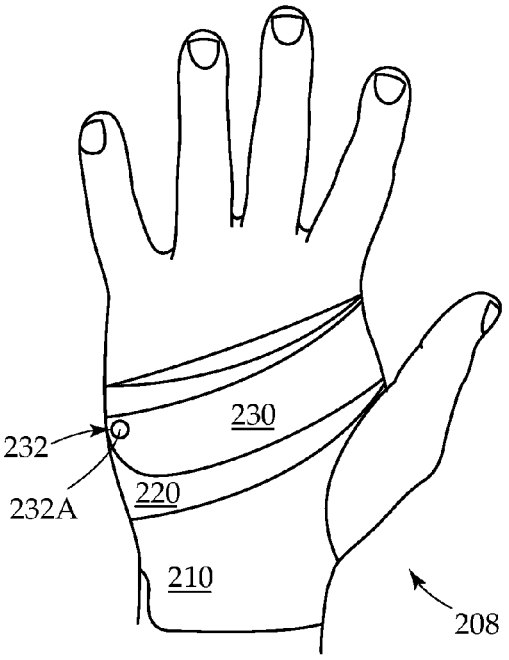
FIGS. 6A-B are rear elevation views of another functional resistance exercise apparatus in accordance with the invention having a cover.
Figure 6C:
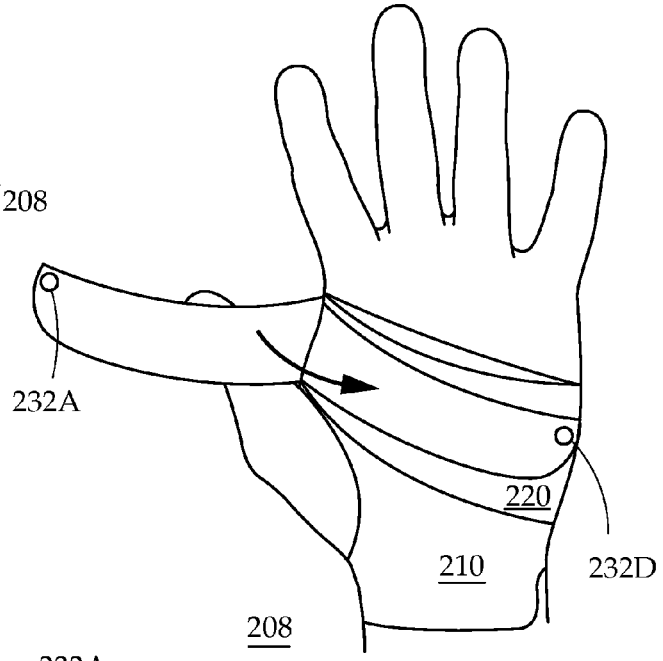
FIG. 6C is a front elevation view of the apparatus of FIGS. 6A-B.
Figure 6B:
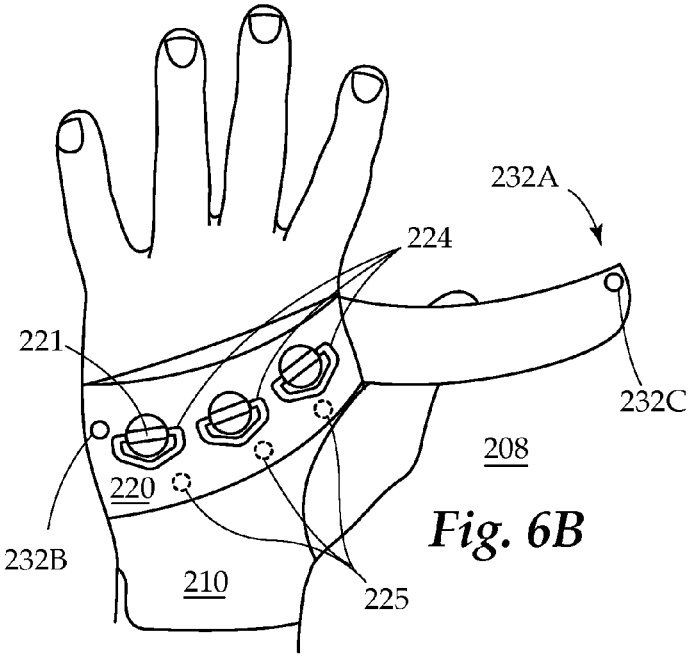

Variations on the loop cover are contemplated, as shown in FIGS. 6-8. For example, in FIG. 6, glove 208 includes main section 210 and reinforced section 220. As shown in FIG. 6B, three loops 224 are swivel mounted to reinforced section 220 via swivel mounts 221. Cover 230 includes a snap-type mechanism 232 that allows the user to snap cover 230 either over loops 224 as shown in FIG. 6A or onto the palm of the glove as shown in FIG. 6C. More specifically, snap mechanism 232 includes four mating snap halves, 232A-D. Snap halves 232A and 232C are disposed on opposite sides of cover 230 and are configured to mate with snap halves 232D and 232B, respectively, disposed on the main body of the glove. Specifically, when the user wants to uncover loops 224, the user secures snap half 232A to snap half 232D on the palm of the glove to move cover 230 out of the way of loops 224. When the user wants to cover loops 224, the users secures snap half 232C to snap half 232B.

Figure 7A:
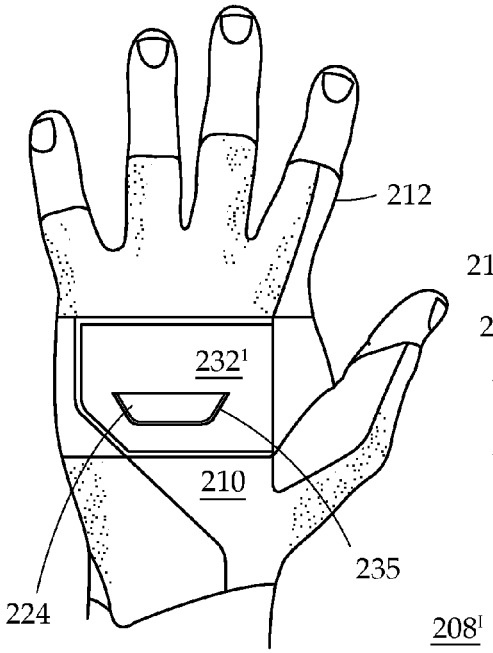
FIGS. 7A-B are rear elevation views of a slightly modified functional resistance exercise apparatus in accordance with the invention having a cover.
Figure 7B:
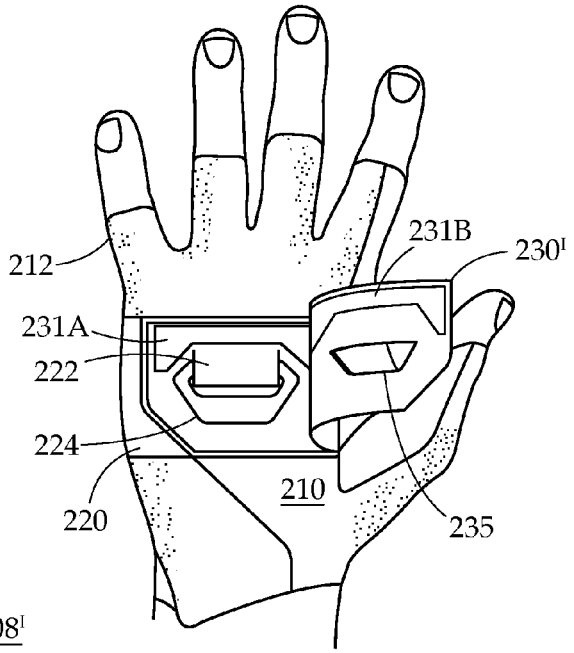

FIGS. 7A-B depict a variation on the above-mentioned cover. Here, glove 208' has cover 230' securable over ring 224 via hook-and-loop-type fastener 231 (e.g., Velcro®). One half 231A (e.g., the hook portion) is disposed on the back of glove 208' substantially near ring 224, and the other mating half 231B (e.g., the loop portion) is disposed on the underside of cover 230'. The precise locations of the mating halves 23 lA and 23 lB are not important as long as one half is disposed on the cover and the other half is disposed on the glove so that the engagement of one half to the other causes the cover to be atop the loop and/or ring. Cover 230' also optionally is provided with a slot 235 through which ring 224 may be secured when covered to reduce the overall profile of the glove and to minimize any jiggling or flapping of ring 224 when not in use.

Figure 8A:
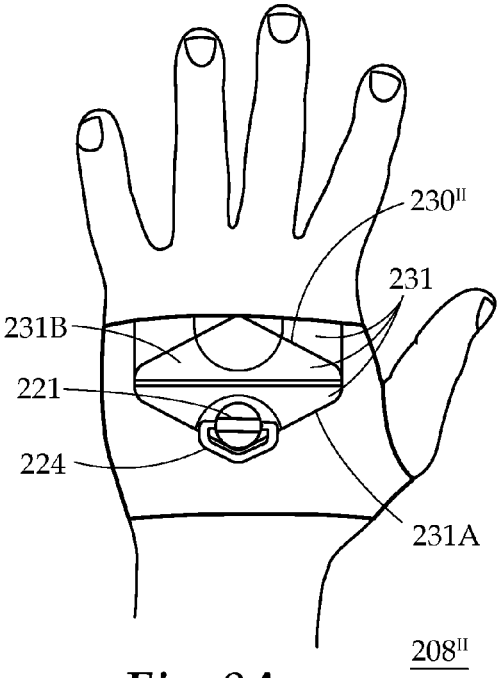
FIGS. 8A-B are rear elevation views of yet another slightly modified functional resistance exercise apparatus in accordance with the invention having a cover.
Figure 8B:
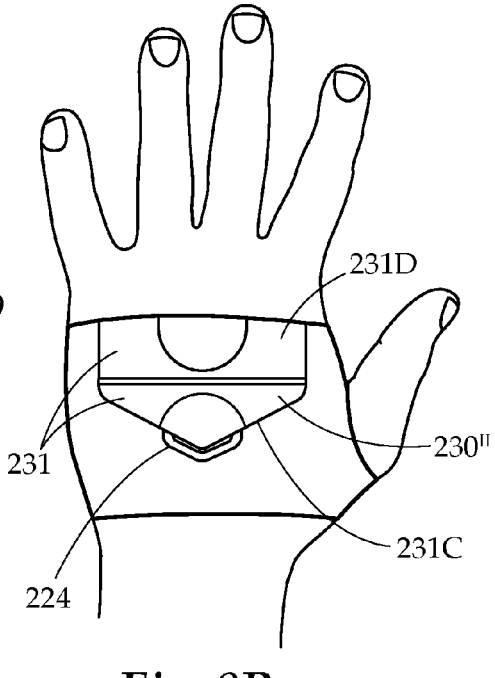
Figure 9A:
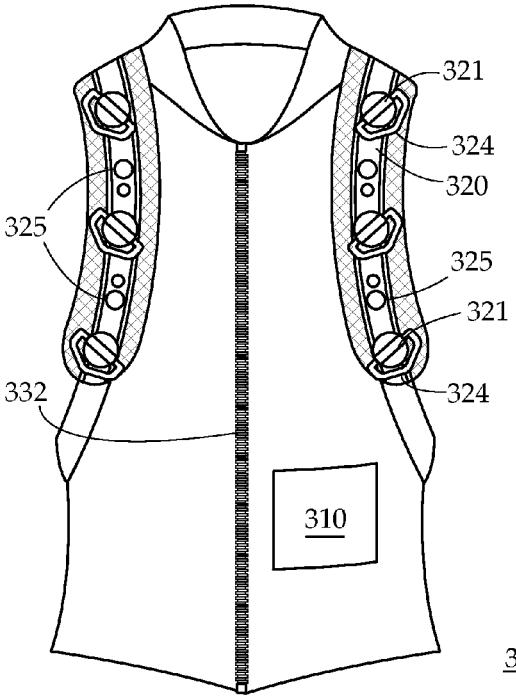
FIGS. 9A-B are front and rear elevation views of a functional resistance exercise torso-covering garment in accordance with the invention for use with any of the glove apparatuses shown in FIGS. 1-8.
Figure 9B:
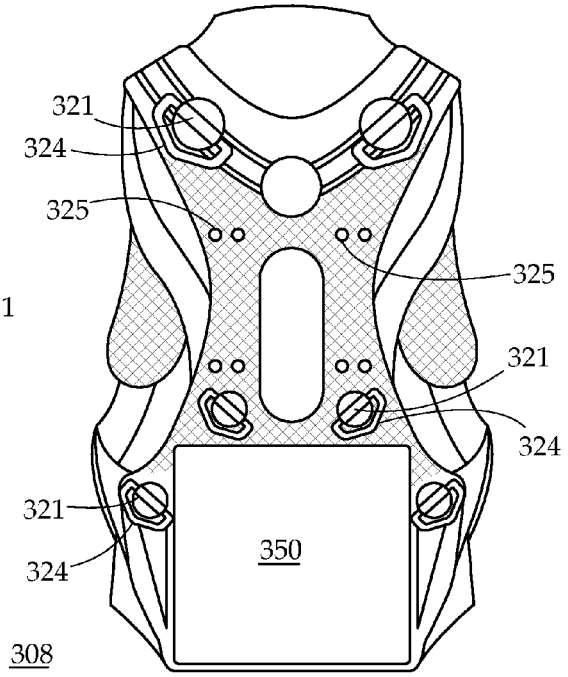
Figure 10A:
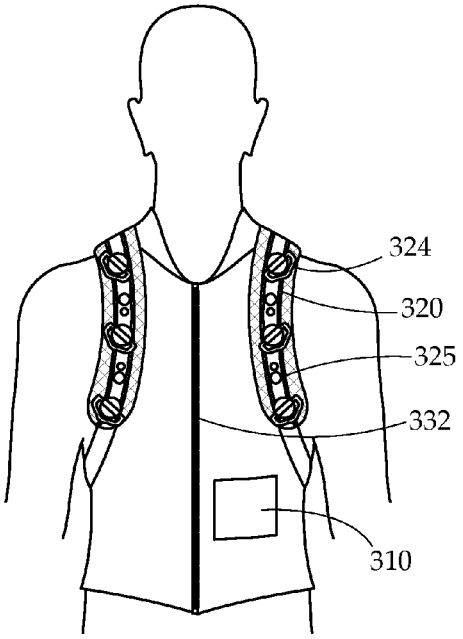
FIGS. 10A-B are front and rear elevation views of the torso-covering garment of FIGS. 9A-B shown being worn by a user.
Figure 10B:
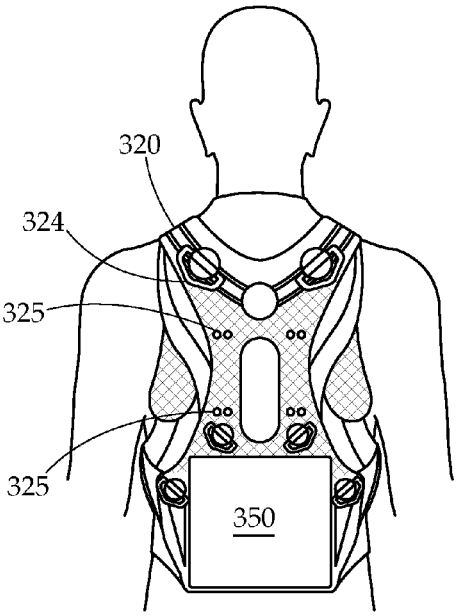

FIGS. 8A-B show another modified version of the glove having a cover that can remain open. Here, glove 208" includes cover 230", and four sections of hook and loop fastener 231A-D. The underside of cover 230" includes hook-and-loop-type fastener half 231B, engageable with mating hook-and-loop-type fastener half 231A disposed on the back of the glove. The top side of cover 230" includes hook-and-loop-type fastener half 231C engageable with mating hook-and-loop-type fastener half 231D also disposed on the back of the glove. Cover 230" is folded down to cover loop/ring 224 as shown in FIG. 8B, and it is folded up to expose loop/ring 224 as shown in FIG. 8A.

Figure 5:
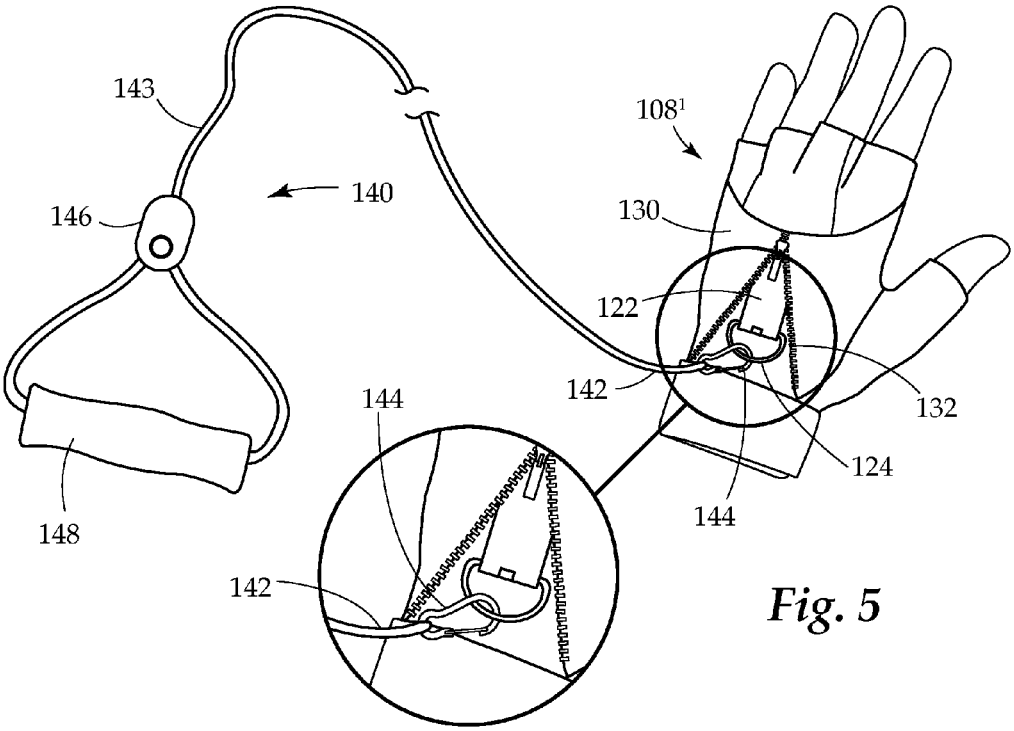
FIG. 5 is a schematic of a functional resistance exercise apparatus in accordance with the invention having an elastic band resistive element.
Figure 11:
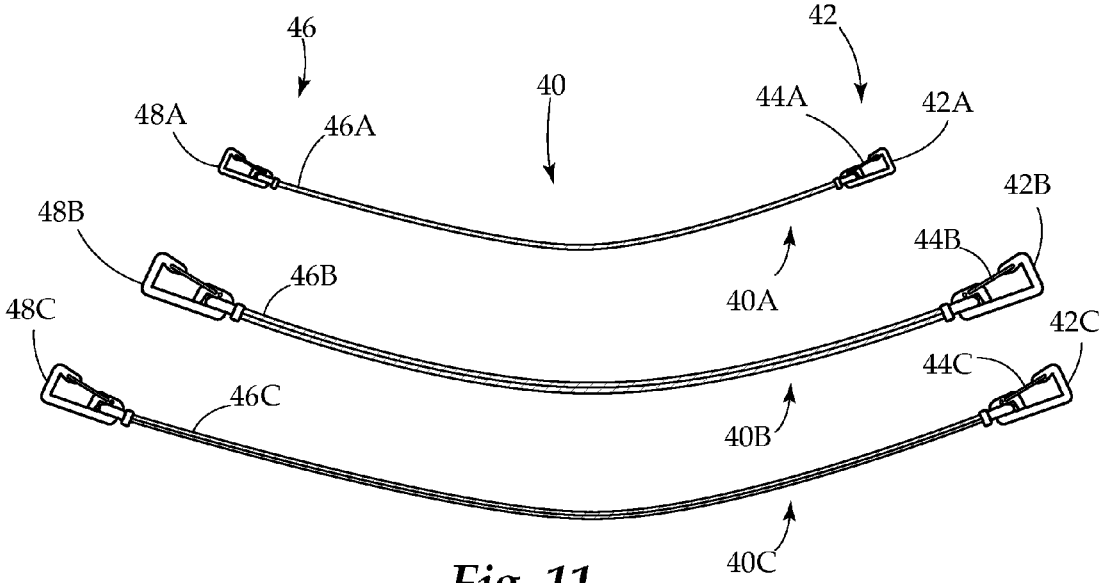
FIG. 11 is a schematic of multiple elastic band resistive elements in accordance with the invention.

The glove itself, be it glove 8, 8', 8", 108, 108", 208, 208', or 208" (or variations thereof), offers no functional resistance to the user's movements unless a resistive element is connected to the glove. One embodiment of the resistive element of the invention is shown in FIGS. 5 and 11 as elastic band 140 and 40, respectively. Elastic band 140 includes a first end 142 having a ring 144 secured thereon. Preferably, ring 144 is a selectively openable ring such as a lobster hook (as shown in the insert of FIG. 5) or a carabiner, e.g., a metal loop with a sprung or screwed gate. It is more preferable that the gate of ring 144 be spring biased instead of screw openable, as it is typically easier and faster to secure or remove a spring-biased gate loop than a screwed shut gate. In any event, end 142 of elastic band 140 is adapted to be attached to either loop 22/122 or ring 24/124 of the glove.

The elastic band need not necessarily be provided with a ring at its first end. Instead, as shown, for example, in FIG. 6B, one or more holes 225 may be provided through glove 208, preferably through reinforced portion 220. The elastic band may be threaded through one or more of holes 225 instead of hooking onto ring 224. In this case, the glove material between two holes 225 being utilized serves as the securing loop to which the resistive element is attached.

The main section 143 of elastic band 140 is resilient and can be stretched or pulled upon numerous times without tearing or rupturing. Unlike a typical cable and pulley type exercise machine, which affords the user resistance in only one direction or a limited number of directions, elastic band 140 will offer a resistive force to any motion made by the user that tends to elongate the band. The elastic material can be designed to provide anywhere from very slight resistance to great resistance to the user's movement. It is preferred that the invention include several elastic bands of varying resistive strength that can be mixed and matched to provide great variability in the amount of resistance that can be generated. For example, as shown in FIG. 11, bands 40A, 40B, and 40C are each provided with varying resistive strengths. Each band has a first end 42A-C with an openable loop or ring 44A-C, respectively.

Figure 12:
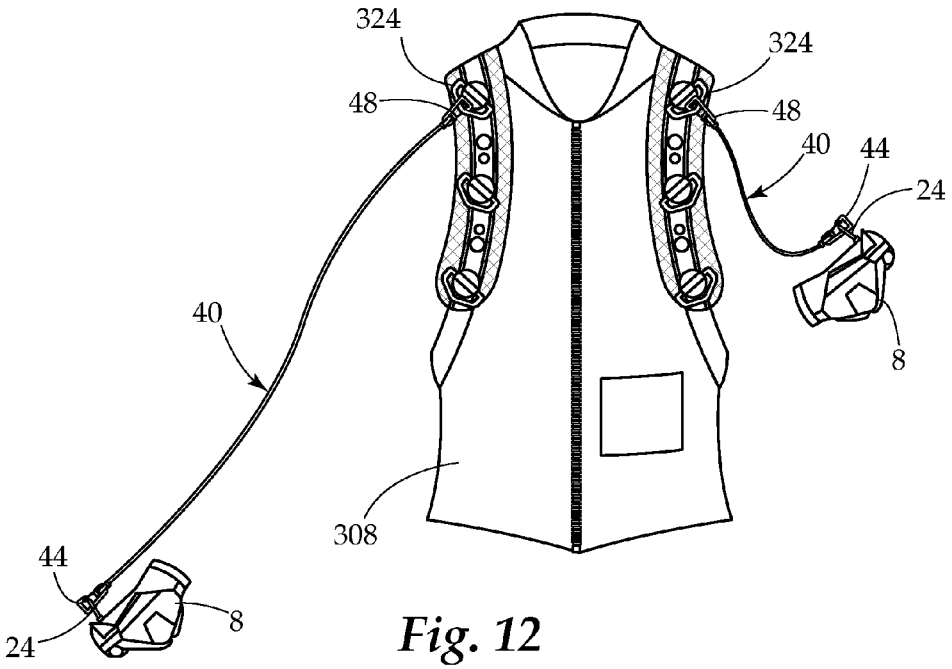
FIG. 12 is a front view of the torso-covering garment of FIGS. 9-10 with a pair of gloves attached via a pair of elastic band resistive elements in accordance with the invention.

The second end of elastic band 40 or 140 must be securable to a relatively fixed point. To enable the securing of second end 46A-C, second end 46A-C each may be provided with an openable ring 48A-C similar to the one disposed at the first end 42A-C, e.g., a lobster hook or carabiner. In such a case, second ends 46A-C may be secured to a fixed hook on a wall or floor, or to an exercise machine, or the like. Alternatively, as shown in FIG. 5, second end 146 may be provided with handle 148 for holding by a hand other than the hand wearing the inventive glove. For example, the user's trainer or workout buddy could hold handle 148 while the user attempted to move his gloved hand away. Less optimally, the user could hold handle 148 is his non-gloved hand. As another option, the second end 46 of elastic band 40 may be secured to a complementary torso-covering garment such as vest 308 shown in FIGS. 9-10. Vest 308 serves as a convenient "portable" fixed point to which to attach the distal end 46 of elastic band 40. One does not always have a personal trainer or a workout buddy handy to grab end 46 of elastic band 40, nor is there always a convenient fixed spot to attach a clip or even to tie or wrap the second end around. However, one does have one's own body wherever one goes. Vest 308 is adapted to be worn about the torso of the user and provide a variety of stable points to which to attach the second end of the elastic band. As with the glove, vest 308 includes a main section 310 and a more rugged, less elastic reinforced section 320. A plurality of loops 324 are preferably attached to the reinforced section of the vest, preferably swivel mounted thereto via swivel mounts 321. In addition or in the alternative, a plurality of holes 325 may be provided through which the elastic band may be threaded as mentioned above. Vest 208 is closable about the person's torso through any number of conventional closing mechanisms, e.g., zipper 332, or laces, snaps, etc. As an added option, vest 308 may include its own built-in parachute (not shown), stowable in parachute carrier 350, for enabling the user to perform conventional air resistance training. Vest 308 may also include a leg or crotch strap (not shown) to prevent the vest from moving up off of the wearer should the wearer move his arms upward (e.g., when doing military presses, an overhand throw of a ball, etc.). The securement of two gloves to vest 308 via two elastic bands 40 is shown in FIG. 12.

In operation, the invention works as follows. The user places a glove on one or both of his hands, secures one end of one or more resistive elements such as elastic band 140 to the glove and the other end of the resistive element to a substantially fixed point, such as a wall-mounted hook, or to one of the rings 324 or holes 325 of vest 308.

Figure 13:
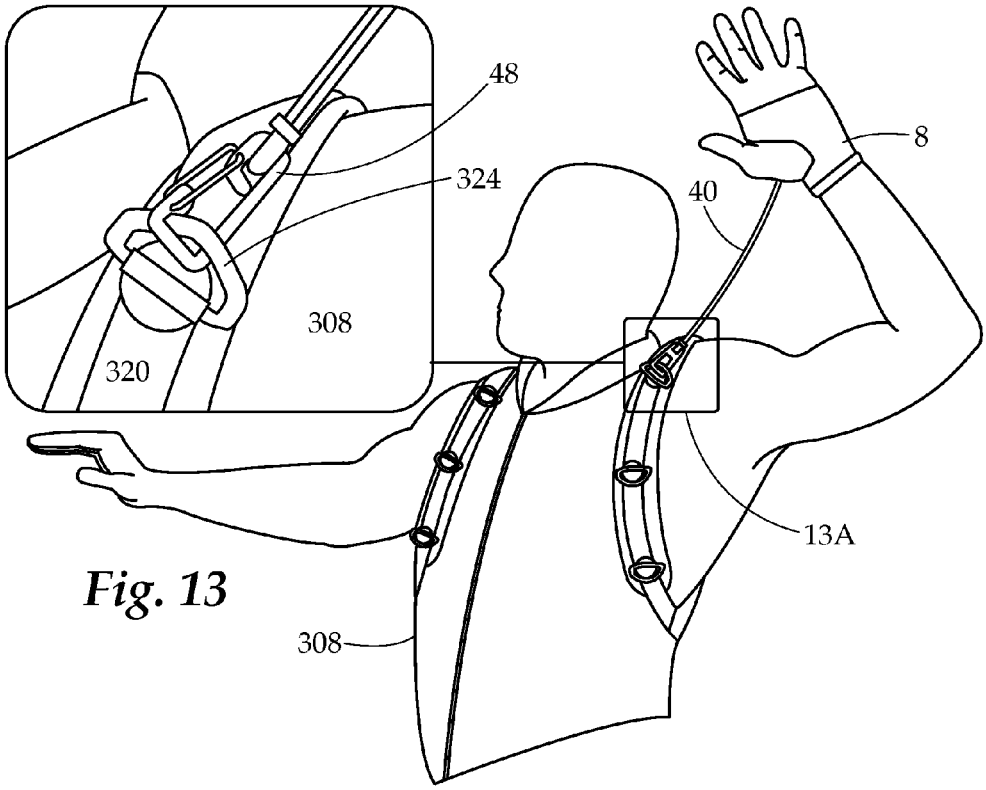
FIG. 13 is a schematic of a person using the inventive combination of FIG. 12 in an exemplary manner.

Alternatively, the user may secure the glove directly to a cable of a conventional cable- and-pulley-type exercise machine. The user may now perform any movement of his arms conceivable, and the resistive element(s) will generate force in opposition to that movement. As a result, the user may perform routine movements common in sports and receive strength training benefits therefrom. For example, as shown in FIGS. 13 and 13A, a quarterback Q can practice throwing a football F while wearing the glove 8 and vest 308 to augment his arm strength without interfering with the mechanics of his throw or risking injury to his shoulder (e.g., by using a weighted ball). As another example, a boxer can practice throwing a variety of punches, from any angle, all of which will safely be made more difficult owing to the resistance applied by the elastic bands connecting his hands to the vest (and in the case of the boxer, may also serve as a reminder to keep his hands up near his face/chin). Additionally, the invention is excellent as an aid to physical therapy for patients recovering from most upper body injuries.

Figure 14A:
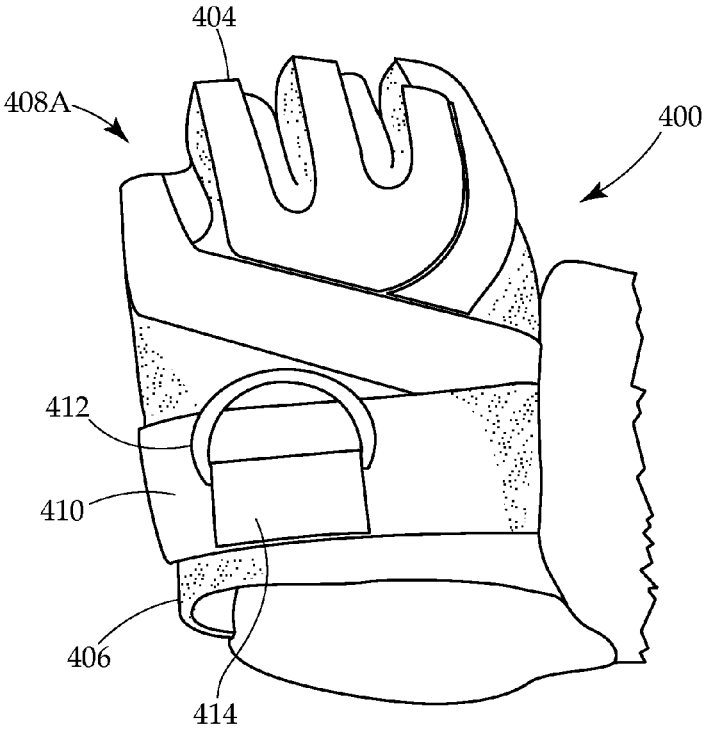
FIGS. 14A-C illustrate an alternate embodiment of the glove showing a top surface of the glove with a bridge section.
Figures 14B, 14C, 15A:
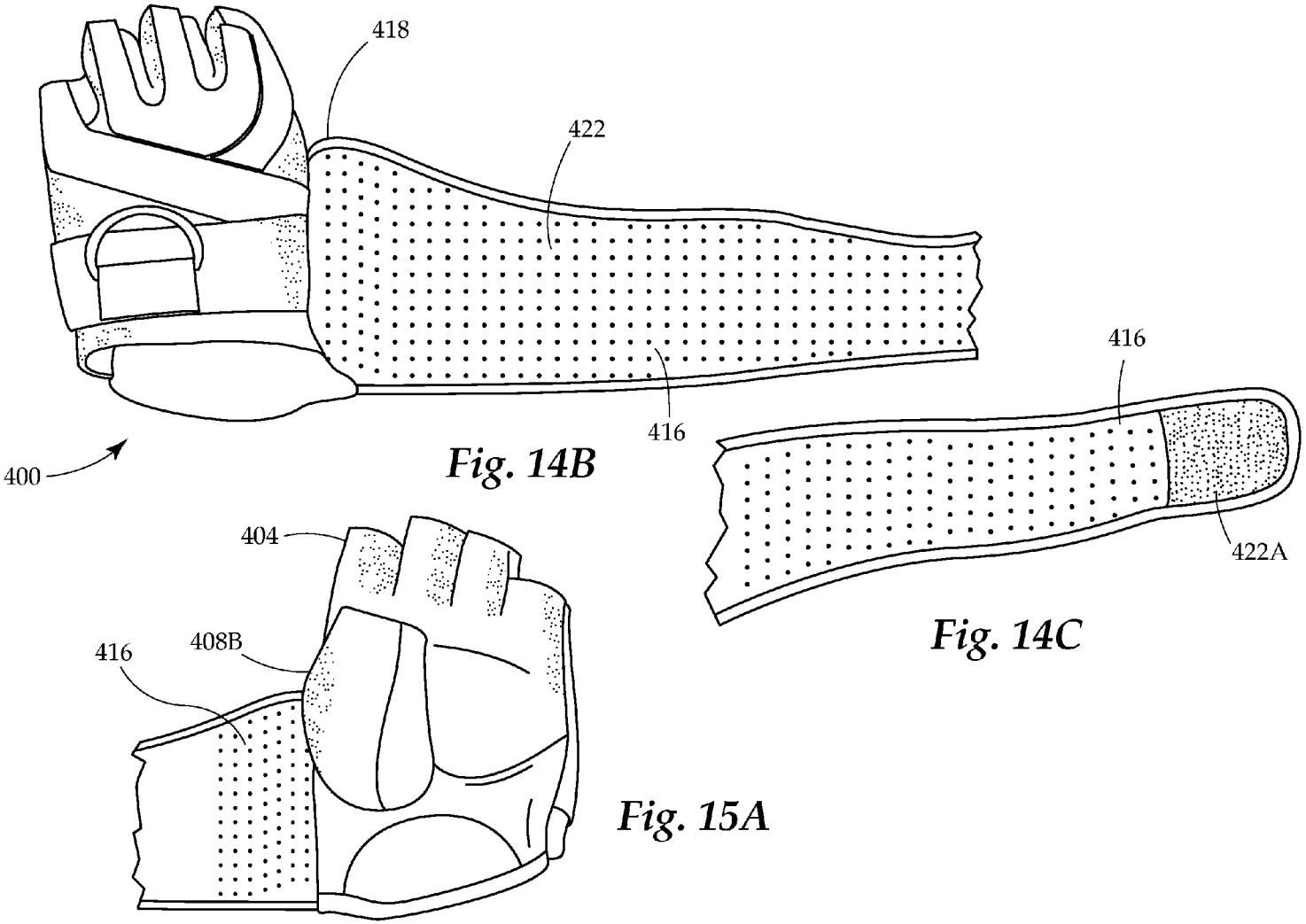
FIGS. 15A-C illustrate the alternate embodiment of the glove showing the bottom surface of the glove with a wrist support mechanism.

FIGS. 14A-C illustrates yet another embodiment of the functional resistance exercise apparatus, wherein in this embodiment a glove 400 is disclosed comprising a main section 402, a plurality of fingers 404 and a wrist section 406. Preferably, the glove 400 includes a top surface 408A and a bottom surface 408B, wherein the top surface further comprises a bridge section 410 which spans the wrist section 406 of the glove 400. In one embodiment, the bridge section 410 includes at least one ring 412 secured to the bridge section 410 via an attachment means 414. Additionally, the glove 400 preferably comprises a wrist support mechanism 416, which extends outwardly from the wrist section 406 of the glove.

In one embodiment, the wrist support mechanism 416 is wider at the attachment point 418 to the glove 400 than at the other end of the wrist support mechanism 416. Additionally, the wrist strap support mechanism 416 includes an opening 420, wherein the opening is able to receive the ring 412 located on the bridge section 410 during use by an individual (see FIG. 16A). In yet another embodiment, the wrist support mechanism 416 includes a first securing means 422A that works in conjunction with a second securing means 422B (see FIG. 15C) to secure the wrist support mechanism 416 around a user's wrist during use of the glove 400.

Figure 15B:
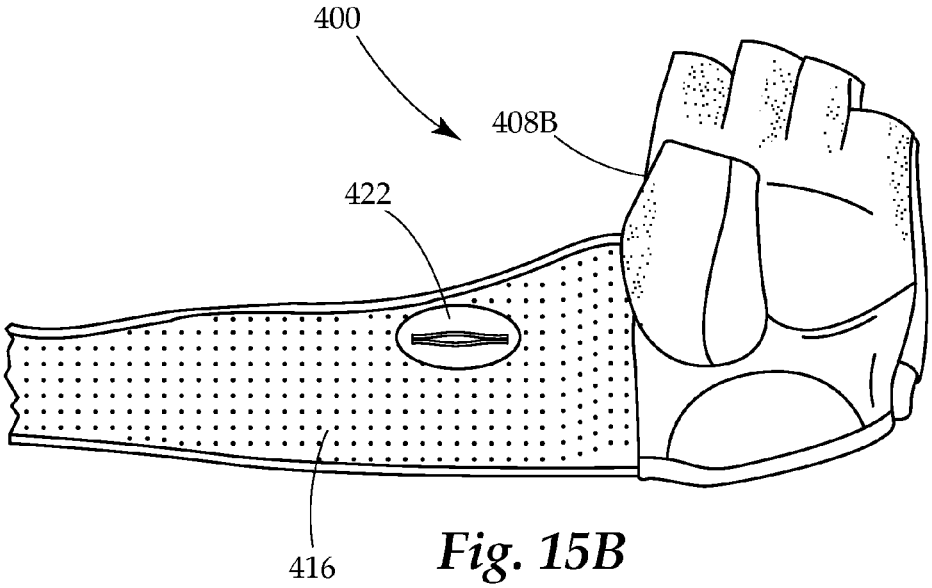
Figure 15C:
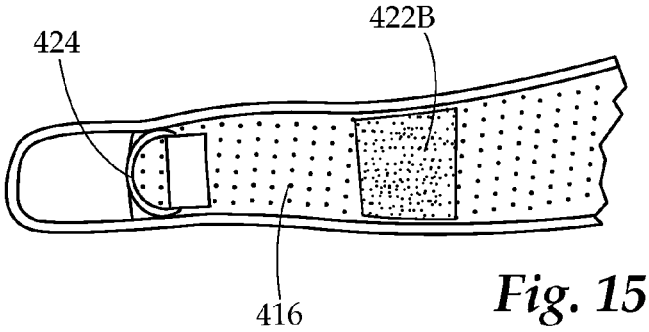

FIGS. 15A-C illustrate the bottom surface 408B of the glove 400 and the wrist support mechanism 416, wherein the wrist support mechanism 416 includes the second securing means 422B and a ring 424. The ring 424 on the bottom surface 408B of the wrist support mechanism 416 is attached at an end opposite the attachment means 418 to the glove 400.

Figure 16A:
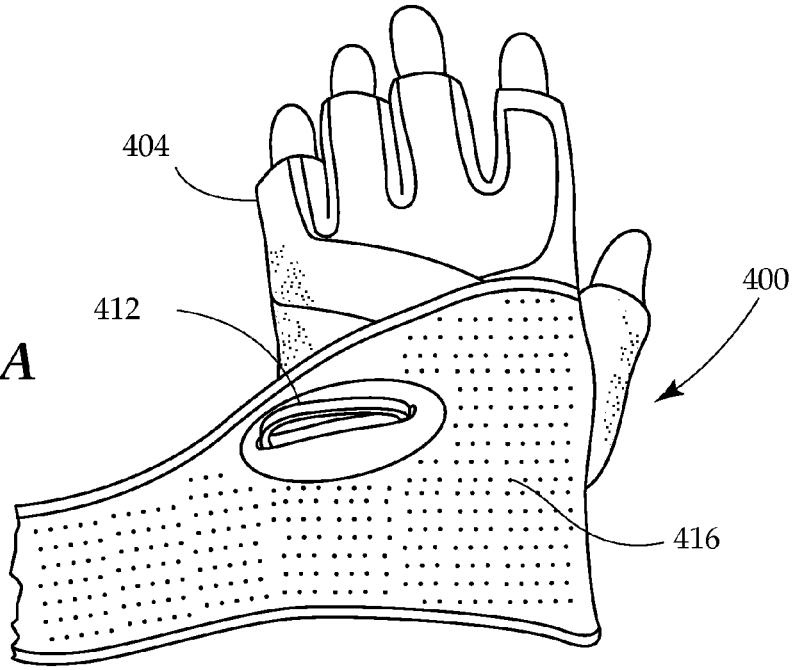
FIGS. 16A-B illustrate the top surface of the glove in a closed position with the wrist support mechanism secured around a user's wrist.
Figure 16B:
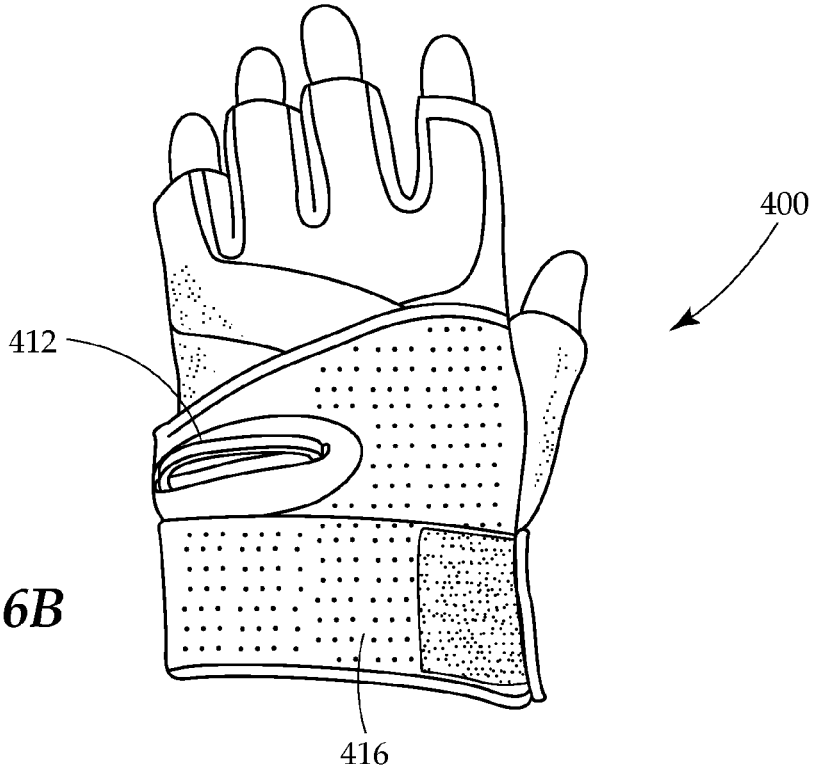

FIGS. 16A-B illustrate the top surface 408A of the glove 400, wherein the wrist support mechanism 416 has received the ring 412 secured to the bridge section 410 and been wrapped once over a user's wrist. In FIG. 16B, the wrist support mechanism 416 is fully secured via the first securing means 422A and the second securing means 422B in a "closed" position ready for use by the user.

Figure 17:
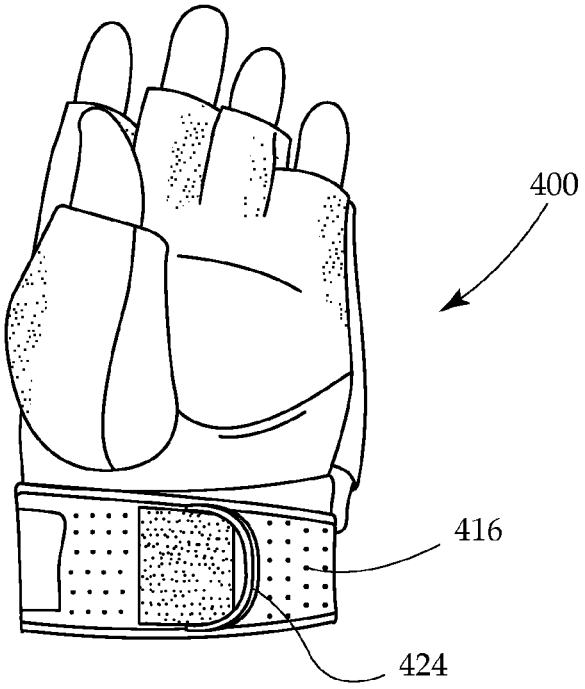
FIG. 17 illustrates the bottom surface of the glove in a closed position with the wrist support mechanism secured around a user's wrist.

FIG. 17 illustrates the bottom surface 408B of the glove 400 showing the glove in the "closed" position with the wrist support mechanism fully secured.

As disclosed above in earlier embodiments of the functional resistance exercise apparatus, this embodiment of the glove 400 may be compatible with the torso covering garment such as the vest 308 and the elastic band 140.

The invention is not limited to the above description. For example, the glove may be made from any suitable material, including but not limited to cowhide leather, rubber, polyester, spandex, nubuck, deerskin, vegatable tanned leather, chrome tann, synthetic leather, alum tanned leather, rawhide leather, buckskin leather, patent leather, shagreen leather, belting leather, nappa leather, bonded leather, bycast leather, aniline leather, boiled leather, bonded leather, chamois leather, corithian leather, morocco leather, ostrich leather, poromeric imitation leather, clarion, koskin, lorica, birko, birkibur, kydex, cork leather, ocean leather, presstoff, pseudo leather, vegan micro fibers, naugahyde, durabuck, nusuede, hydrolit, ultra suede, and the like.

Having described certain embodiments of the invention, it should be understood that the invention is not limited to the above description or the attached exemplary drawings. Rather, the scope of the invention is defined by the claims appearing hereinbelow and any equivalents thereof as would be appreciated by one of ordinary skill in the art.

What is claimed is:

1. A functional resistance exercise apparatus comprising:

a glove, wherein the glove further comprises:

a main section;

a plurality of fingers;

a wrist section;

a top surface, wherein the top surface further comprises:
a bridge section, wherein the bridge section spans the wrist section of the glove;
at least one ring secured to the bridge section via an attachment means;
a bottom surface; and
a wrist support mechanism, wherein the wrist support mechanism extends outward from the wrist section of the glove;
an opening located on the wrist support mechanism, wherein the opening is able to receive the ring located on the bridge section during use; and
a first securing means and a second securing means located on the wrist support mechanism, wherein the securing means work in conjunction to secure the wrist support mechanism around a user's wrist during use of the glove.

2. The functional resistance exercise apparatus of claim 1, further comprising:
a ring located on a bottom surface of the wrist support mechanism.

3. The functional resistance exercise apparatus of claim 2, wherein the wrist support mechanism is wider at an attachment point to the glove than at another end of the wrist support mechanism.

4. The functional resistance exercise apparatus of claim 3, wherein the ring on the bottom surface of the wrist support mechanism is attached at the another end opposite the attachment point to the glove.

5. The functional resistance exercise apparatus of claim 4, further comprising:
a resistive element attachable to the ring on the bridge section of the glove.

6. The functional resistance exercise apparatus of claim 5, wherein the resistive element further comprises:
a cable having a first end secured to the ring on the bridge section of the glove and a second end; and
a weight securable to the second end of the cable.

7. A functional resistance exercise system comprising:
a glove, wherein the glove further comprises:
a main section;
a plurality of fingers;
a wrist section;
a top surface, wherein the top surface further comprises:
a bridge section, wherein the bridge section spans the wrist section of the glove;
at least one ring secured to the bridge section via an attachment means;
a bottom surface;
a wrist support mechanism, wherein the wrist support mechanism extends outward from the wrist section of the glove; and
a torso-covering garment, wherein the torso-covering garment further comprises:
a main section;
a reinforced section; and
a plurality of loops attached to the reinforced section via swivel mounts;
a parachute carrier, wherein the parachute carrier is able to stow a built-in parachute located within the torso-covering garment;
a resistive element attachable to the ring on the bridge section of the glove, wherein the resistive element further comprises:
an elastic band securable to the ring on the bridge section of the glove, wherein one end of the elastic band is securable to the ring on the bridge section of the glove and the other end of the elastic band is securable to one of the loops on the reinforced section of the torso-covering garment;
an opening located on the wrist support mechanism, wherein the opening is able to receive the ring located on the bridge section during use; and
a first securing means and a second securing means located on the wrist support mechanism, wherein the securing means work in conjunction to secure the wrist support mechanism around a user's wrist during use of the glove.

8. The functional resistance exercise apparatus of claim 7, further comprising:
a ring located on a bottom surface of the wrist support mechanism.

9. The functional resistance exercise apparatus of claim 8, wherein the wrist support mechanism is wider at an attachment point to the glove than at another end of the wrist support mechanism.

10. The functional resistance exercise apparatus of claim 9, wherein the ring on the bottom surface of the wrist support mechanism is attached at the another end opposite the attachment point to the glove.

* * * * *